US005643017A

United States Patent [19]

Jinno

[11] Patent Number: 5,643,017

[45] Date of Patent: Jul. 1, 1997

[54] FEMALE TERMINAL AND METHOD OF PRODUCING THE SAME

[75] Inventor: Keishi Jinno, Shizuoka, Japan

[73] Assignee: Yazaki Corporation, Tokyo, Japan

[21] Appl. No.: 381,066

[22] Filed: Jan. 31, 1995

[30] Foreign Application Priority Data

Jan. 31, 1994 [JP] Japan ..... 6-009538

[51] Int. Cl.[6] ..... H01R 13/187

[52] U.S. Cl. ..... 439/843

[58] Field of Search ..... 439/842, 843, 439/849, 850–856, 861, 862, 885

[56] References Cited

U.S. PATENT DOCUMENTS 4,560,231 12/1985 Shirai ..... 439/843
5,226,842 7/1993 Endo et al. ..... 439/843
5,433,629 7/1995 Yagi et al. ..... 439/843
5,441,428 8/1995 Hamai et al. ..... 439/843

*Primary Examiner*—David L. Pirlot
*Attorney, Agent, or Firm*—Sughrue, Mion, Zinn, Macpeak & Seas

[57] ABSTRACT

To provide a female terminal used in an electric circuit, as well as a method of producing such a terminal, a resilient contact piece, mounted within a receptive portion for receiving a male terminal, is positively retained, thereby providing the female terminal with a high reliability. In the female terminal, a resilient contact piece is mounted within a receptive portion formed by bending an electrically-conductive metal sheet. A retaining projection and a retaining hole are provided at each of side walls of the receptive portion. With this construction, retaining ends of the resilient contact piece are engaged respectively in the retaining holes, and even if the side walls are curved by pressing forces applied during a bending operation, the retaining projections positively retain the retaining ends of the resilient contact piece.

4 Claims, 5 Drawing Sheets

FEMALE TERMINAL AND METHOD OF PRODUCING THE SAME

BACKGROUND OF THE INVENTION

This invention relates to a female terminal used in an electric circuit and also to a method of producing such a terminal.

One conventional female terminal for mounting on a connector used for the connection of an electric circuit is formed by a method in which a sheet of metal such as copper and brass is blanked, and then this blank is bent to form a body portion, and a resilient contact piece is mounted within this body portion to provide the female terminal for receiving a mating male terminal. Particularly, there has been proposed such a female terminal of a two-component type in which the resilient contact piece is made of a highly-resilient metal sheet different from a material of the body portion. For example, Japanese Patent Unexamined Publication No. 58-87789 discloses a method of producing a female electrical connection terminal T as shown in FIG. 8.

In the production of the female electrical connection terminal T, a blank P (FIG. 9A), formed by blanking a sheet of metal such as copper and brass, is bent along broken lines L to form a body portion a. Small piece portions b', c' and d' are formed on the blank P, and retaining holes e are formed through this blank. The blank is bent to form the body portion a of the female electrical connection terminal T having insulator clamping portions b, conductor clamping portions c and a tubular portion d, as shown in FIG. 8.

Then, a separate resilient contact piece f (FIG. 9B) is mounted within the tubular portion d, with end portions g1 of retaining portions g engaged respectively in the retaining holes e in the body portion a.

Referring to the process of bending the blank P and mounting the resilient contact piece f, the small piece portions d' are first bent to extend obliquely from a base plate portion h, and then the resilient contact piece f is solenoid valve set in position, with the end portions g1 of the retaining portions g disposed in registry with the retaining holes e in the body portion a respectively, as shown in FIG. 10. Then, the small piece portions d' are further bent perpendicularly relative to the base plate portion, so that the end portions g1 of the retaining portions g are engaged respectively in the retaining holes e, as shown in FIG. 11. Then, the small piece portions d' are bent by applying pressing forces W to distal end portions $d_1$' thereof, thereby forming the tubular portion d, as shown in FIG. 12.

At this time, however, side walls $d_2$ of the tubular portion d are curved under the influence of the pressing forces W, so that the end portions of the retaining portions g may be disengaged from the retaining holes e, respectively, thus causing the resilient contact piece f to be dislodged. Thus, there is encountered a problem that defective products, having the incompletely-mounted resilient contact piece f, can be produced.

SUMMARY OF THE INVENTION

Figure 1:
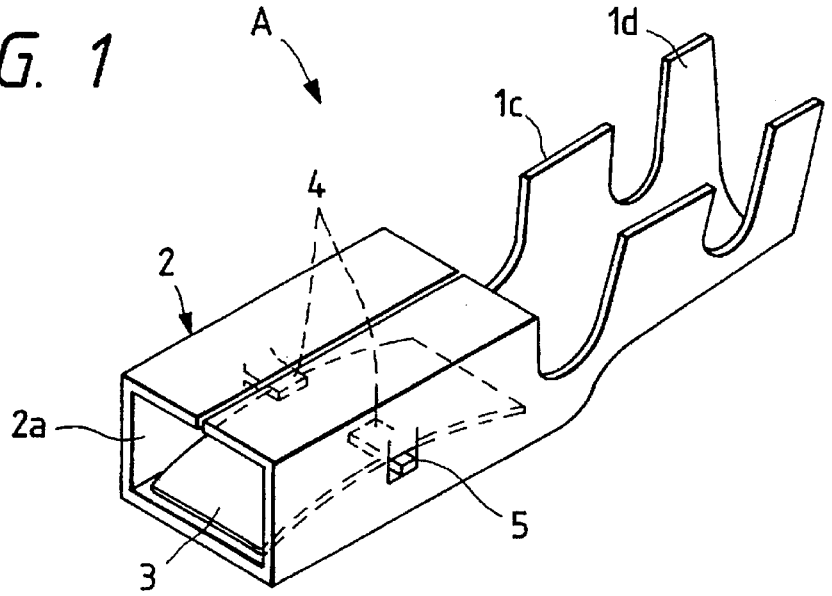
FIG. 1 is a perspective view of a preferred embodiment of a female terminal of the present invention.

With the above problem in view, it is an object of this invention to provide a female terminal, as well as a method of producing the same, in which a resilient contact piece is positively retained within a receptive portion, thus providing the female terminal with a high reliability.

The above object has been achieved by a female terminal wherein a resilient contact piece is mounted within a receptive portion formed by bending an electrically-conductive metal sheet; characterized in that a retaining projection and a retaining hole are formed at each of side walls of the receptive portion; and retaining ends of the resilient contact piece are retained by the retaining projections, respectively.

According to another aspect of the invention, there is also provided a method of producing a female terminal comprising the steps of forming a terminal blank, having a base plate portion and electrical contact portions, by blanking an electrically-conductive metal sheet; cutting and raising portions of the electrical contact portions of the terminal blank to form retaining holes and retaining projections; causing the electrical contact portions to stand obliquely relative to the base plate portion, so that retaining ends of a resilient contact piece are disposed adjacent to the retaining holes, respectively; subsequently bending the electrical contact portions generally perpendicularly relative to the base plate portion to form side walls of a receptive portion, so that the resilient contact piece is retained by the side walls; and subsequently bending distal end portions of the electrical contact portions to form the receptive portion.

According to still another aspect of the invention, there is also provided a method of producing a female terminal comprising the steps of forming a terminal blank, having a base plate portion and electrical contact portions, by blanking an electrically-conductive metal sheet; stamping portions of the electrical contact portions of the terminal blank to form retaining holes and retaining projections; causing the electrical contact portions to stand obliquely relative to the base plate portion, so that retaining ends of a resilient contact piece are disposed adjacent to the retaining holes, respectively; subsequently bending the electrical contact portions generally perpendicularly relative to the base plate portion to form side walls of a receptive portion, so that the resilient contact piece is retained by the side walls; and subsequently bending distal end portions of the electrical contact portions to form the receptive portion.

In the present invention, the retaining projections are formed respectively on the side walls of the receptive portion which receives a mating terminal, and therefore even if the side walls of the receptive portion are curved by an external force produced during a bending operation, the retaining ends of the resilient contact piece provided within the receptive portion will not be disengaged, and hence the resilient contact piece is kept retained stably within the receptive portion.

DESCRIPTION OF THE PREFERRED EMBODIMENTS

Figure 2:
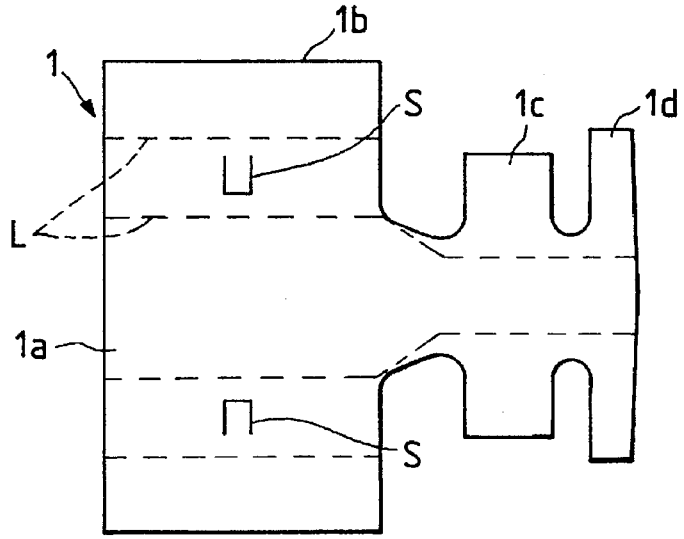
FIG. 2 is a plan view of a terminal blank for forming the female terminal of FIG. 1.

FIG. 1 is a perspective view of a preferred embodiment of a female terminal A of the present invention. The female terminal A is formed by blanking a terminal blank 1 from an electrically-conductive metal sheet and then by bending this terminal blank, as shown in FIG. 2, and a resilient contact piece 3 formed of a different electrically-conductive metal sheet is mounted within a tubular receptive portion 2 which receives a mating male terminal.

Figure 3:
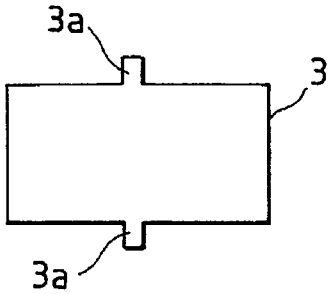
FIG. 3 is a plan view of a resilient contact piece mounted within a receptive portion of the female terminal of FIG. 1.
Figure 14A:
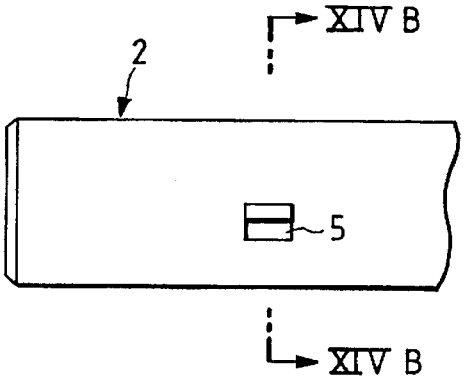
FIG. 14A is a fragmentary side view showing a receptive portion according to a modification of the invention.
Figure 14B:
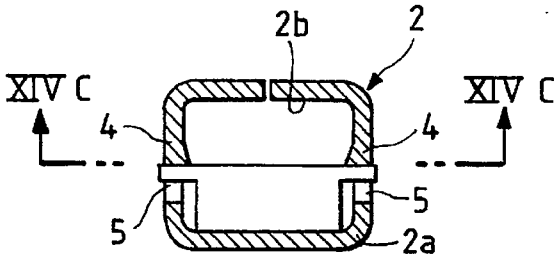
FIG. 14B is a cross-sectional view showing the receptive portion taken along the line XIVB—XIVB of FIG. 14A.
Figure 14C:
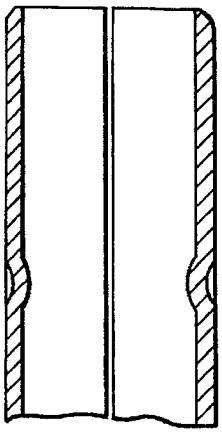
FIG. 14C is a longitudinal sectional view showing the receptive portion taken along the line XIVC—XIVC of FIG. 14B.

In the terminal blank 1, each of electrical contact portions 1*b*, conductor connection portions 1*c* and insulator clamping portions 1*d* are formed integrally with a base plate portion 1*a*, and are disposed symmetrically with respect to the base plate portion 1*a*, and the terminal blank is bent along broken lines L, so that the receptive portion 2 is formed. In the electrical contact portions 1*b*, predetermined portions S of those portions which form side walls 2*a* of the receptive portion 2 are cut and raised to form retaining projections 4, extending into the receptive portion 2, and retaining holes 5 in which retaining ends 3*a* (FIG. 3) of the resilient contact piece 3 are engaged, respectively. As a modification, as shown in FIGS. 14A, 14B and 14C, the retaining projections 4, extending into the receptive portion 2, and retaining holes 5 may be formed by stamping the relevant portions of the side walls 2*a* instead of cutting and raising the relevant portions of the side walls 2*a*.

Figure 4:
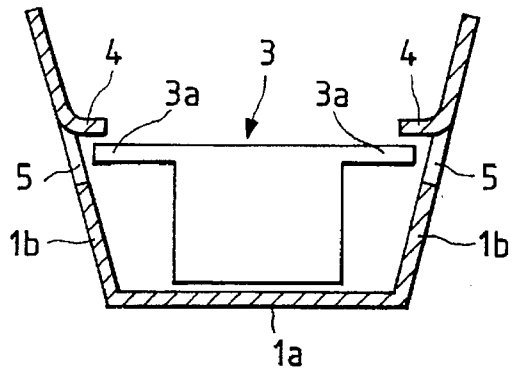
FIG. 4 is a view explanatory of a process step of producing the female terminal of FIG. 1.

In the process of producing the female terminal A, first, the electrical contact portions 1*b* are bent obliquely relative to the base plate portion 1*a* of the terminal blank 1, as shown in FIG. 4, and the predetermined portions of those portions which form the side walls 2*a*of the receptive portion 2 are cut and raised to form the retaining projections 4 and the retaining holes 5. Then, the retaining ends 3*a* of the resilient contact piece 3 are disposed adjacent to the retaining holes 5, respectively.

Figure 5:
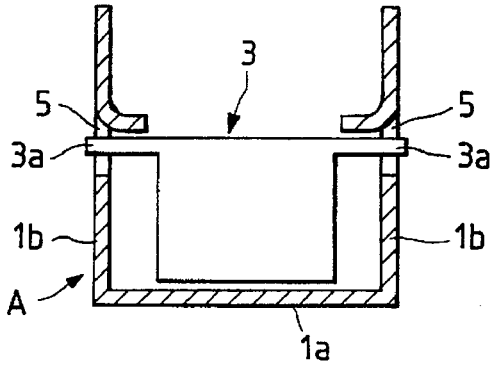
FIG. 5 is a view explanatory of a process step subsequent to the step of FIG. 4.

Then, the two electrical contact portions 1*b* are further bent perpendicularly relative to the base plate portion 1*a*, so that the retaining ends 3*a* of the resilient contact piece 3 are engaged respectively in the retaining holes 5, and the resilient contact piece 3 is retained between the upstanding electrical contact portions 1*b* (which form the side walls 2*a* of the receptive portion 2, respectively), as shown in FIG.5.

Figure 6:
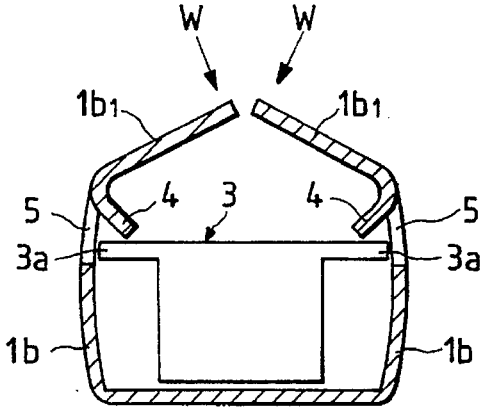
FIG. 6 is a view explanatory of a process step subsequent to the step of FIG. 5.
Figure 7:
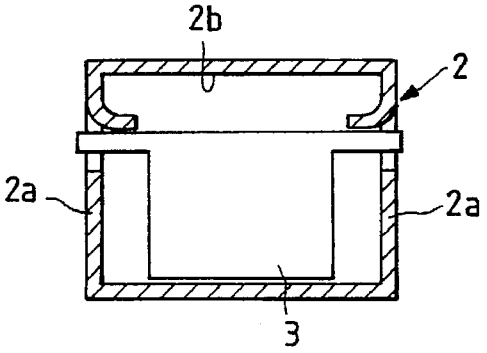
FIG. 7 is a cross-sectional view showing a condition in which the receptive portion of the female terminal is formed after the step of FIG. 6.
Figure 8:
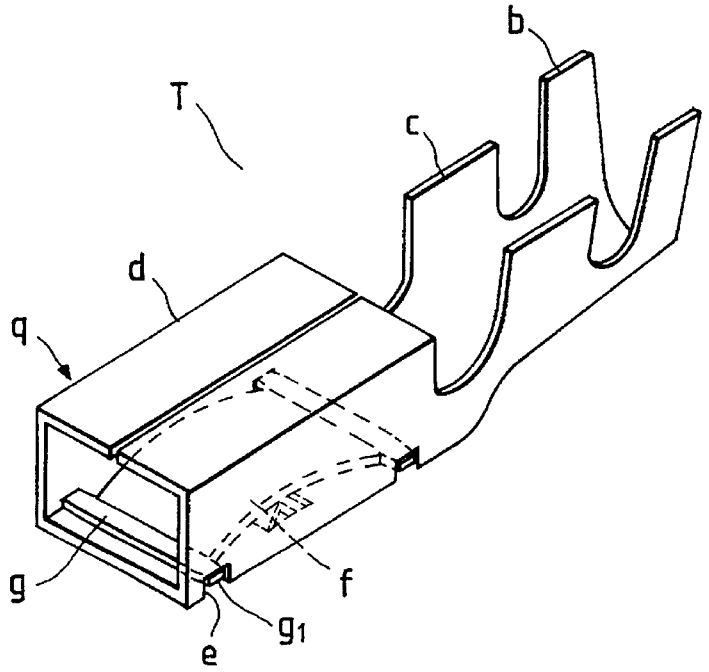
FIG. 8 PRIOR ART
FIG. 8 is a perspective view of a conventional female terminal.
Figure 9A:
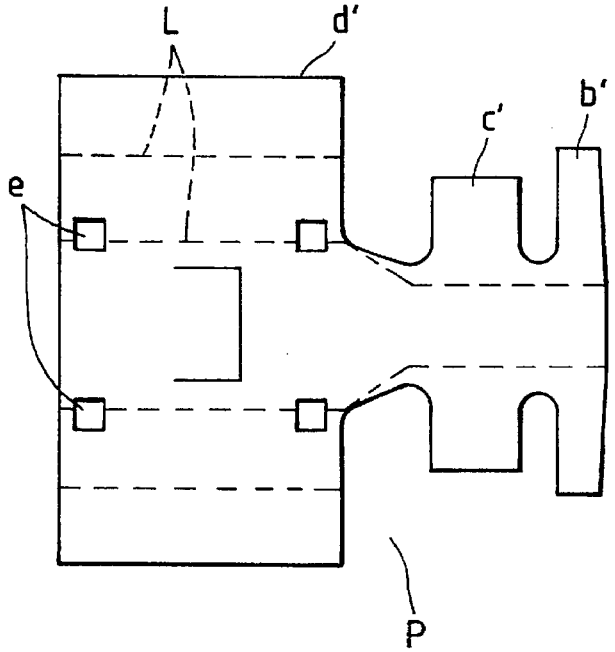
FIG. 9A PRIOR ART
FIGS. 9A and 9B are plan views showing a blank for forming the female terminal and the elastic contact plate of FIG. 8.
Figure 9B:
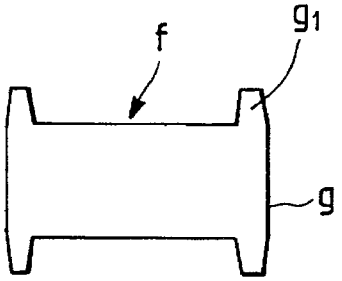
FIG. 9B PRIOR ART
Figure 10:
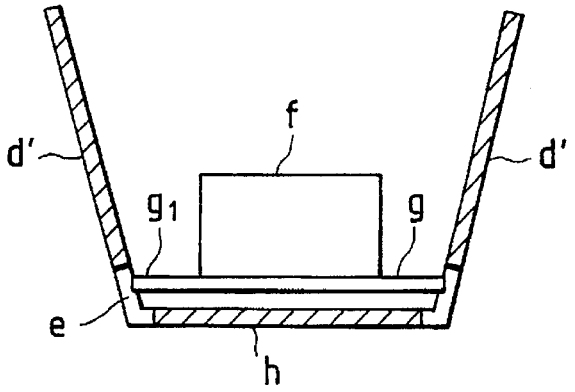
FIG. 10 PRIOR ART
FIG. 10 is a view explanatory of a process step of forming the female terminal of FIG. 8.
Figure 11:
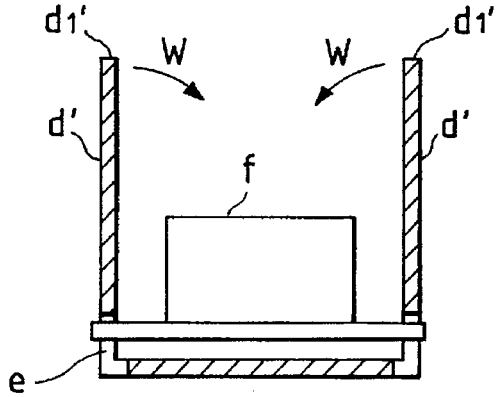
FIG. 11 PRIOR ART
FIG. 11 is a view explanatory of a process step subsequent to the step of FIG. 10.
Figure 12:
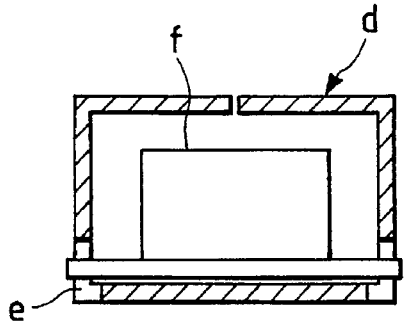
FIG. 12 is a cross-sectional view showing a condition in which a tubular portion of the female terminal is formed after the step of FIG. 11.
Figure 13:
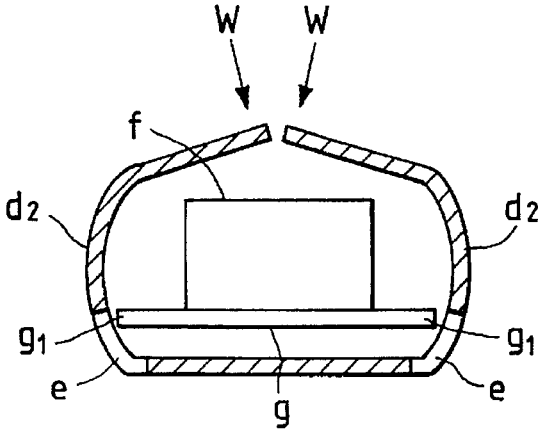
FIG. 13 is a view showing a condition in which side walls of the tubular portion are curved in the step of FIG. 11.

Then, distal end portions $1b_1$ (which form a top wall 2*b* of the receptive portion 2) of the two electrical contact portions 1*b* are bent by applying pressing forces W thereto as shown in FIG. 6, so that the receptive portion 2, having the side walls 2*a* and the top wall 2*b*, is formed as shown in FIG. 7.

At this time, although the electrical contact portions 1*b* (which form the side walls 2*a*) are curved to bulge outwardly under the influence of the pressing forces W, the retaining ends 3*a* of the resilient contact piece 3 will not be disengaged because of the provision of the retaining projections 4, and therefore the resilient contact piece is kept retained stably within the receptive portion 2.

The length of projecting of the retaining projections 4 is determined depending on the amount of deformation of the side wall 2*a* due to the pressing force W, and if this length is too large, the retaining projections adversely affect the mounting of the resilient contact piece 3, and therefore the length of the retaining projections need to be suitably determined.

In the present invention, the retaining projections are formed respectively on the side walls of the receptive portion which receives the mating terminal, and therefore even if the side walls of the receptive portion are curved by an external force produced during the bending operation, the retaining ends of the resilient contact piece provided within the receptive portion will not be disengaged, and hence the resilient contact piece is kept retained stably within the receptive portion, and the rate of production of the defective products is greatly lowered, which provide advantages that the productivity in the production process is enhanced and that the reliability of the products is greatly enhanced.

What is claimed is:

1. In a female terminal wherein a resilient contact piece is mounted within a receptive portion formed by bending an electrically-conductive metal sheet, the improvement wherein a retaining projection and a retaining hole are formed in each of a pair of upwardly bent side walls which define said receptive portion; and said resilient contact piece includes retaining ends which are retained against upward movement by said retaining projections, respectively such that said resilient contact piece is thereby fixedly secured in said receptive portion.

2. In the female terminal of claim 1, the improvement wherein said retaining ends of said resilient contact piece are received in said retaining holes, respectively.

3. A method of producing a female terminal comprising the steps of:

forming a terminal blank, having a base plate portion and electrical contact portions, by blanking an electrically-conductive metal sheet;

cutting and raising portions of said electrical contact portions of said terminal blank to form retaining holes and retaining projections;

causing said electrical contact portions to stand obliquely relative to said base plate portion, so that retaining ends of a resilient contact piece are aligned with said retaining holes, respectively;

subsequently bending said electrical contact portions generally perpendicularly relative to said base plate portion to form side walls, extending in an upward perpendicular direction, of a receptive portion, so that said retaining ends respectively pass through said retaining holes and are fixedly retained by said retaining projects against upward movement in said upward perpendicular direction such that said resilient contact piece is fixedly retained by said side walls; and subsequently bending distal end portions of said electrical contact portions to form said receptive portion.

4. A method of producing a female terminal comprising the steps of:

forming a terminal blank, having a base plate portion and electrical contact portions, by blanking an electrically-conductive metal sheet;

stamping portions of said electrical contact portions of said terminal blank to form retaining holes and retaining projections adjacent thereto;

causing said electrical contact portions to stand obliquely relative to said base plate portion, so that retaining ends of a resilient contact piece are aligned with said retaining holes, respectively;

subsequently bending said electrical contact portions generally perpendicularly relative to said base plate portion to form side walls, extending in an upward perpendicular direction, of a receptive portion, so that said retaining ends respectively pass through said retaining holes and are fixedly retained by said retaining projections against upward movement in said upward perpendicular direction such that said resilient contact piece is retained by said side walls; and subsequently bending distal end portions of said electrical contact portions to form said receptive portion.

* * * * *